US006080808A

United States Patent [19]

Sterzel

[11] Patent Number: 6,080,808

[45] Date of Patent: Jun. 27, 2000

[54] INJECTION-MOLDING COMPOSITIONS CONTAINING METAL OXIDES FOR THE PRODUCTION OF METAL MOLDINGS

[75] Inventor: Hans-Josef Sterzel, Dannstadt-Schauernheim, Germany

[73] Assignee: BASF Aktiengesellschaft, Ludwigshafen, Germany

[21] Appl. No.: 09/002,833

[22] Filed: Jan. 5, 1998

[30] Foreign Application Priority Data

Jan. 7, 1997 [DE] Germany ..... 197 00 277

[51] Int. Cl.[7] ..... C08L 59/00; C08K 3/20

[52] U.S. Cl. ..... 524/430; 524/431; 524/432; 524/593; 106/460; 106/479; 106/480

[58] Field of Search ..... 524/431, 430, 524/593, 432; 106/460, 479, 480

[56] References Cited

U.S. PATENT DOCUMENTS

| | | | |
|---|---|---|---|
| 4,415,528 | 11/1983 | Wiech, Jr. | 419/46 |
| 4,421,660 | 12/1983 | Hajna | 524/431 |
| 4,604,259 | 8/1986 | Whitman | 75/247 |
| 5,001,181 | 3/1991 | Takagi et al. | 524/431 |
| 5,190,898 | 3/1993 | Ter Maat et al. | 501/127 |
| 5,417,917 | 5/1995 | Takahar et al. | 419/2 |
| 5,686,676 | 11/1997 | Jech et al. | 75/247 |

OTHER PUBLICATIONS

*Pat. Abst. of Japan.*, vol. 18, No. 15, C–1151, Jan. 12, 1994 (JP 05 254945A, Oct. 5, 1993).

*Primary Examiner*—Andrew E. C. Merriam
*Attorney, Agent, or Firm*—Keil & Weinkauf

[57] ABSTRACT

The molding composition contains, in a flowable binder, from 20 to 50% by vol., based on the total volume of the molding composition, of a powder comprising one or more metal oxides and, if desired, metal carbides and/or metal nitrides which cannot be reduced using hydrogen, where at least 65% by vol. of the powder has a maximum particle size of 0.5 $\mu$m and the remainder of the powder has a maximum particle size of 1 $\mu$m, and at least 90% by vol. of the powder comprises metal oxides which can be reduced using hydrogen. The metal oxides which can be reduced using hydrogen are $Fe_2O_3$, FeO, $Fe_3O_4$, NiO, CoO, $Co_3O_4$, CuO, $Cu_2O$, $Ag_2O$, $Bi_2O_3$, $WO_3$, $MoO_3$, SnO, $SnO_2$, CdO, PbO, $Pb_3O_4$, $PbO_2$ or $Cr_2O_3$, or mixtures thereof.

9 Claims, No Drawings

INJECTION-MOLDING COMPOSITIONS CONTAINING METAL OXIDES FOR THE PRODUCTION OF METAL MOLDINGS

The present invention relates to molding compositions, in particular injection-molding compositions, containing metal oxides which are suitable for the production of metal moldings, and to a process for the production of metal moldings.

In the production of small, complex metal moldings by powder injection molding, metal powders having powder diameters of from 2 to 40 $\mu$m are mixed with a flowable binder, and this mixture, as usual in the processing of plastics, is injected into a mold by injection-molding machines under pressures of up to 2000 bar. In the mold, the composition usually solidifies since the mold has a lower surface temperature than the injected composition, and the binder is cooled in the mold to a temperature below the glass transition temperature or melting point.

The mold is then opened, and the shaped part is removed. The binder is then removed from the resultant molding, during which the latter should not be deformed. The binder removal ("debindering") can be carried out in various ways. The usually organic binder can be thermally decomposed, and thus removed, by carefully increasing the temperature over an extended period. The binder may also be constructed in such a way that it is partially soluble in a solvent, and this component can be extracted with the solvent. The remainder of the binder is then decomposed thermally, which can be carried out more quickly than in the first variant since an open-pore body is already present after extraction of the soluble binder component, and the thermal decomposition therefore does not build up an internal pressure which could destroy the molding. The most elegant debindering method uses a catalytic process, in which the binder used is, for example, a polyacetal, which is depolymerized directly to gaseous formaldehyde without the formation of a liquid phase and below its melting point in the presence of gaseous acids. This process proceeds from the outside inward in the molding walls, which means that the entire gas exchange can again only take place in the already porous volume components, and a disadvantageous internal pressure again cannot be built up. This process has the further advantage that the debindering process takes place at below the melting point of the binder, and the molding therefore does not change its dimensions in a disadvantageous manner. Very dimensionally accurate moldings are thus obtained. The deviation of the linear dimensions from the nominal size is a maximum of ±0.3%, often less. However, the roughness of the moldings is determined essentially by the powder size used, so that the roughness $R_z$ cannot be less than 1 $\mu$m. The production of parts having lower roughness values would require metal powders having a diameter smaller than 2 $\mu$m. However, the preparation of metal powders of this type is extremely expensive, and handling of such fine metal powders causes considerable difficulties. With decreasing particle size, the ratio between surface area and volume increases, and the chemical reactivity of the metal powders thus continues to increase. Non-noble metals, such as iron, cobalt, zinc and nickel, thus become pyrophoric and can no longer be processed in air.

In addition, the particle sizes in the preparation of metal powders by spraying metal melts are scarcely below 5 $\mu$m. Furthermore, it is frequently impossible to comminute the metal powders further by grinding since they are excessively ductile.

However, there is a demand for finer molding compositions for the production of metal moldings since newer methods have allowed the production of ever-finer mold inserts for injection molding. The LIGA process allows the production of, for example, tool inserts by means of which parts with dimensions in the micron region and roughness values in the nanometer region can be produced by injection molding.

In the LIGA process, a photosensitive polymer layer, known as a photoresist, is applied to a base plate and exposed through a mask containing a cross section of the structures to be produced. The areas of the polymer layer which are exposed through the mask become soluble and can therefore be washed out. The resultant trenches are filled electro-chemically by a metal layer, after which the photoresist which remains is dissolved. The resultant metal structure can be used as a mold insert for an injection mold.

It is an object of the present invention to provide molding compositions or injection-molding compositions for the production of metal moldings which have a property profile which allows them to be used in very fine mold inserts, for example from the LIGA process. The resultant moldings should correspond in fineness and surface quality to the molds produced by the LIGA process.

We have found that this object is achieved by molding compositions containing, in a flowable binder, from 20 to 50% by vol., based on the total volume of the molding composition, of a powder comprising one or more metal oxides and, if desired, metal carbides and/or metal nitrides which cannot be reduced using hydrogen, where at least 65% by vol. of the powder has a maximum particle size of 0.5 $\mu$m and the remainder of the powder has a maximum particle size of 1 $\mu$m, and at least 90% by vol. of the powder comprises metal oxides which can be reduced using hydrogen.

It has been found, in accordance with the invention, that metal powders with large particle sizes, which are difficult to obtain and handle, can be replaced by metal-oxide powders having particle sizes of below 1 $\mu$m in the production of molding compositions. The molding compositions or injection-molding compositions are shaped to give a molding, the binder is removed, and the molding is sintered with reduction of the metal oxides in a hydrogen-containing, reducing atmosphere.

A powder is used here of which at least 65% by vol. has a maximum particle size of 0.5 $\mu$m, and the remainder has a maximum particle size of 1 $\mu$m. It is particularly preferred for at least 80% by vol. of the powder to have a maximum particle size of 0.5 $\mu$m. At least 90% by vol. of the powder comprises metal oxides which can be reduced using hydrogen, the remainder of the powder comprising metal oxides, metal carbides and/or metal nitrides which cannot be reduced using hydrogen.

Suitable metal oxides are those which can be reduced using hydrogen and are sinterable, so that metal moldings can be produced therefrom by heating under a hydrogen atmosphere or in the presence of hydrogen. Examples of metals whose oxides can be used are found in groups VIB, VIII, IB, IIB and IVA of the Periodic Table. Examples of suitable metal oxides are $Fe_2O_3$, FeO, $Fe_3O_4$, NiO, CoO, $Co_3O_4$, CuO, $Cu_2O$, $Ag_2O$, $WO_3$, $MoO_3$, SnO, $SnO_2$, CdO, PbO, $Pb_3O_4$, $PbO_2$ and $Cr_2O_3$. The lower oxides are preferred, such as $Cu_2O$ instead of CuO and PbO instead of $PbO_2$, since the higher oxides are oxidants which can react under certain conditions with, for example, organic binders. The oxides may be employed individually or as mixtures. For example, pure-iron moldings or pure-copper moldings can be obtained in this way. If mixtures of the oxides are used, alloys and doped metals, for example, can be obtained.

For example, iron oxide/nickel oxide/molybdenum oxide mixtures allow the production of steel parts, and copper oxide/tin oxide mixtures, which may also contain zinc oxide, nickel oxide or lead oxide, allow the production of bronzes. Particularly preferred metal oxides are iron oxide, nickel oxide and/or molybdenum oxide.

The metal oxides having a maximum particle size of 1 $\mu$m, preferably 0.5 $\mu$m, that are used in accordance with the invention can be prepared by various processes, preferably by chemical reaction. For example, the hydroxides, oxide hydrates, carbonates or oxalates can be precipitated from solutions of metal salts, the particles being produced in very finely divided form, if desired, in the presence of dispersants. The precipitates are separated off and purified to the greatest extent possible by washing. The precipitated particles are dried by heating and converted into the metal oxides at elevated temperature.

It is also possible to obtain very finely divided metal oxides directly in a single step. For example, combustion of iron pentacarbonyl in the presence of oxygen gives extremely fine, spherical iron oxide particles having a specific surface area of up to 200 $m^2/g$.

The metal oxides employed in accordance with the invention, or at least 65% by vol. of the powder, preferably have a BET surface area of at least 5 $m^2/g$, preferably at least 7 $m^2/g$.

Besides the metal oxides which can be reduced using hydrogen, further metal compounds which cannot be reduced during sintering, such as metal oxides, metal carbides or metal nitrides which cannot be reduced using hydrogen, may also be present. Examples of oxides here are $ZrO_2$, $Al_2O_3$ and $TiO_2$. Examples of carbides are SiC, WC and TiC. An example of a nitride is TiN.

The powder employed in accordance with the invention in the molding compositions preferably comprises at least 90% by vol., particularly preferably at least 95% by vol., based on the powder, of metal oxides which can be reduced using hydrogen. If metal oxides, metal carbides and/or metal nitrides which cannot be reduced using hydrogen are used, they are preferably present in an amount of from 1 to 10% by vol., particularly preferably from 2 to 5% by vol., based on the powder.

The powder employed in accordance with the invention is present in the molding compositions in an amount of from 20 to 50% by vol., preferably from 25 to 45% by vol., particularly preferably from 30 to 40% by vol., based on the total volume of the molding composition.

The powder employed in accordance with the invention in the molding compositions is distributed in a flowable binder. A dispersant may additionally be employed. According to a preferred embodiment of the invention, the molding composition consists of the above-described powder, a flowable binder and, if desired, a dispersant.

According to a further embodiment of the invention, the molding composition contains, besides these components, further components as described below.

The total volume of all components of the molding composition is in each case 100% by vol.

Flowable binders which can be employed are all binders which are suitable for use in powder injection molding. They are preferably flowable at the processing temperature, so that they can be injection molded in molds. It is possible to use here, for example, the binders as described above in the prior art. Suitable binders are therefore those which are thermally decomposed and thus removed, binder mixtures of which one component is extracted with solvents and the remainder can be thermally decomposed, or binders used, for example, in the form of a polyacetal which can be depolymerized directly to gaseous products without the formation of a liquid phase and below its melting point in the presence of gaseous acids. Suitable binders are known to the person skilled in the art. The flowable binder preferably contains an organic polymer. Preference is given to a polyoxymethylene copolymer as described, for example, in EP-A-0 444 475, EP-A-0 446 708 and EP-A-0 444 475. This is preferably a polyoxymethylene copolymer containing from 0.5 to 10 mol %, preferably from 1 to 5 mol %, of butanediol formal as comonomer. Polybutanediol formal may be employed as additional binder.

Particular preference is given to a mixture comprising from 75 to 89% by weight of polyoxymethylene copolymer containing 2 mol % of butanediol formal as comonomer and having a melt flow index of about 45 g/10 min at 190° C. and a weight of 2.16 kg, and from 11 to 25% by weight of polybutanediol formal having a molecular weight $M_n$ of about 20,000.

Suitable dispersants are all those which are suitable for dispersal of metal oxide particles having the stated particle size in the binder. A suitable class of substances for the dispersants comprises alkoxylated fatty alcohols or alkoxylated fatty acid amides.

Other suitable components of the molding compositions are the processing stabilizers used in the processing of polyoxymethylene.

The novel molding compositions can be used as injection-molding compositions for the production of metal moldings. The molding compositions are prepared by mixing the organic and inorganic components in suitable mixing equipment. This is preferably carried out in a compounding apparatus with melting of the flowable binder. After the molding compositions have solidified, they are preferably granulated. They can be injection molded by known processes, preferably at material temperatures of from 170 to 200° C. The mold used preferably has a temperature of from 120 to 140° C.

The binder is then removed from the resultant moldings. This can be carried out, depending on the binder used, by slow heating, treatment with a solvent followed by heating, or treatment with an acid followed by heating. The debindering is preferably carried out simultaneously with the heating for reducing and sintering the molding. In this case, the molding is heated to the material-specific sintering temperature at a rate of from 1 to 20° C./min, preferably from 2 to 10° C./min, in the presence of hydrogen, preferably under a hydrogen atmosphere, kept at the sintering temperature for from 1 to 20 hours, preferably for from 2 to 10 hours, and then cooled. The binder is removed during the slow heating phase. The hydrogen employed for reduction preferably has a maximum dew point of −10° C., particularly preferably below −40° C. The dew point is selected so that reduction under the reaction conditions is possible for the metal oxide employed.

The reduction of $Cr_2O_3$ requires, for example, an extremely dry hydrogen having a dew point below −40° C. The reduction is carried out at above 1500° C., particularly preferably at above 1600° C. During sintering of chromium-containing alloys, the alloy constituents frequently sinter at from 1200 to 1300° C., while any $Cr_2O_3$ used can remain in the molding in unreduced form. In the production of, for example, stainless steels having a chromium content of from about 13 to 20% by weight, the chromium content is therefore preferably employed in the form of ferrochrome having a maximum particle size of 1 $\mu$m. The proportion of ferrochrome is preferably less than 35% by vol. It is thus possible to produce stainless steels alloyed with chromium and, if desired, nickel and molybdenum without risking unreduced $Cr_2O_3$ remaining in the otherwise nicely sintered molding.

The invention thus also relates to a process for the production of metal moldings by injection molding a molding composition as described above in a mold, removing the binder from the resultant molding, and reducing and sintering the debindered molding in the presence of hydrogen to give a metal molding. The removal of the binder is preferably carried out thermally in a single step together with the reduction and sintering by heating the molding to the sintering temperature in the presence of hydrogen.

During reductive sintering, the moldings shrink by up to 5-fold, based on the volume, or by up to half, based on the linear dimensions. This high shrinkage rate is particularly advantageous for the production of very small structures, since the injection-molding tool can be designed to be larger by a factor of about 2 in all dimensions, and very fine details can thus be formed. The maximum dimensional tolerances of the sintered moldings, in spite of the absolute shrinkage, are preferably ±0.3%, particularly preferably ±0.15%.

The surface roughness $R_z$ is preferably less than 1 $\mu$m, and $R_a$ is preferably less than 0.2 $\mu$m, measured in accordance with DIN 4768 and DIN 4768/1 respectively.

pounder. The resultant injection-molding compositions were injected, at a material temperature of 180° C., into a mold held at 130° C. for a flexible rod measuring 1.5×6×50 mm.

The flexible rods produced in this way were heated to the stated material-specific sintering temperature at a rate of 2° C./min in a tubular furnace under a hydrogen atmosphere (hydrogen having a dew point of about −10° C.), and kept at the sintering temperature for 2 hours. The furnace was then cooled. During the slow heating phase, the polyoxymethylene and polybutanediol formal depolymerized at from 220 to 300° C. without formation of cracks in the thin-walled flexible rod. The flexible rods were placed on an aluminum oxide powder bed having a particle size of about 5 $\mu$m in order to simplify shrinkage.

All the molding compositions listed in the examples gave flaw- and crack-free moldings, although the volume shrinkage was up to 80% in some cases.

The surface roughness values obtained using a polished injection-molding tool were in each case less than 1 $\mu$m for $R_z$ and less than 0.2 $\mu$m for $R_a$.

TABLE 1

(Composition in grams)

ard - quer

| | Example No. | | | | | | | | | |
|---|---|---|---|---|---|---|---|---|---|---|
| | 1 | 2 | 3 | 4 | 5 | 6 | 7 | 8 | 9 | 10 |
| Oxides employed | | | | | | | | | | |
| $Fe_2O_3$ 9 $m^2/g$ | 2257 | | | | | | | | | |
| $Fe_2O_3$ 20 $m^2/g$ | | 1890 | | 2000 | | | 197 | | | |
| $Fe_2O_3$ 40 $m^2/g$ | | | 1050 | | | | | | | |
| NiO 7 $m^2/g$ | | | | 155 | | | | | 2264 | 679 |
| $Cu_2O$ 9 $m^2/g$ | | | | | 2700 | | | 2112 | | 1974 |
| $MoO_3$ 11 $m^2/g$ | | | | | | 1890 | | | | |
| $WO_3$ 10 $m^2/g$ | | | | | | | 2721 | | | |
| $SnO_2$ 13 $m^2/g$ | | | | | | | | 423 | 968 | |
| Organic components | | | | | | | | | | |
| Polyoxymethylene | 653 | 681 | 848 | 567 | 625 | 584 | 560 | 592 | 507 | 684 |
| Polybutanediol formal | 53 | 85 | 106 | 106 | 53 | 85 | 101 | 85 | 106 | 90 |
| Solsperse 17000 | 51 | 71 | 92 | 92 | 51 | 82 | 87 | 82 | 92 | 77 |
| Sintering temp. in ° C., | 700 | 700 | 600 | 850 | 980 | 1450 | 1450 | 820 | 1090 | 1170 |
| Linear shrinkage in % | 41.3 | 44.3 | 54.2 | 42.3 | 42.5 | 49.8 | 49.3 | 42.2 | 32.9 | 41.4 |

The invention is described in greater detail below with reference to examples.

The injection-molding compositions listed in the examples below were prepared by a standard procedure, thermally debindered, and subjected to reductive sintering under hydrogen at temperatures appropriate to the material.

The flowable binder used was a thermoplastic polyoxymethylene copolymer containing 2 mol % of butanediol formal as comonomer and having a melt flow index of about 45 g/10 min at 190° C. and a weight of 2.16 kg. As additional binder, polybutanediol formal having a molecular weight $M_n$ of about 20,000 was employed. The dispersant used for dispersal of the inorganic powder was Solsperse® 17000 from ICI. The amounts are shown in the table below.

The organic and inorganic components of the molding composition were melted at 190° C. in a paddle compounder with a useful capacity of 11 and compounded for 90 minutes. The paddle compounder was then cooled, and the composition was solidified and granulated in the rotating com-

We claim:

1. A molding composition containing, in a flowable binder in the form of a polyacetal, from 20 to 50% by vol., based on the total volume of the molding composition, of a powder comprising one or more metal oxides and, if desired, metal carbides and/or metal nitrides which cannot be reduced using hydrogen, where at least 65% by vol. of the powder has a maximum particle size of 0.5 $\mu$m and the remainder of the powder has a maximum particle size of 1 $\mu$m, and at least 90% by vol. of the powder comprises metal oxides which can be reduced using hydrogen.

2. A molding composition as claimed in claim 1, wherein at least 65% by vol. of the powder has a BET surface area of at least 5 $m^2/g$.

3. A molding composition as claimed in claim 1, wherein the flowable binder contains a polyoxymethylene copolymer containing from 1 to 5 mol % of butanediol formal as comonomer.

4. A molding composition as claimed in claim 1, which contains a dispersant for the powder.

5. A molding composition as claimed in claim 1, wherein the metal oxides which can be reduced using hydrogen are $Fe_2O_3$, FeO, $Fe_3O_4$, NiO, CoO, $Co_3O_4$, CuO, $Cu_2O$, $Ag_2O$, $Bi_2O_3$, $WO_3$, $MoO_3$, SnO, $SnO_2$, CdO, PbO, $Pb_3O_4$, $PbO_2$ or $Cr_2O_3$, or mixtures thereof.

6. A molding composition as claimed in claim 1, wherein the powder contains from 1 to 10% by vol. of metal oxides, metal carbides or metal nitrides which cannot be reduced using hydrogen, or mixtures thereof, having a maximum particle size of 0.5 $\mu$m.

7. A molding produced from a composition as claimed in claim 1.

8. A process for the production of metal moldings by injection molding a molding composition as claimed in claim 1 in a mold, removing the binder from the resultant molding, and reducing and sintering the debindered molding in the presence of hydrogen to give a metal molding.

9. A process as claimed in claim 8, wherein the removal of the binder is carried out thermally in a single step together with the reduction and sintering by heating the molding to the sintering temperature in the presence of hydrogen.

* * * * *